US005402742A

United States Patent [19]

Kiaulehn

[11] Patent Number: 5,402,742

[45] Date of Patent: Apr. 4, 1995

[54] TRAPEZE FOR SURFERS AND SAILORS

[76] Inventor: Ronald Kiaulehn, Hochriesstrasse 19, D-85560 Ebersberg, Germany

[21] Appl. No.: 114,092

[22] Filed: Aug. 31, 1993

[30] Foreign Application Priority Data

Aug. 31, 1992 [DE] Germany ..... 42 28 423.6

[51] Int. Cl.[6] ..... B63B 17/00

[52] U.S. Cl. ..... 114/39.2; 2/44

[58] Field of Search ..... 114/39.2; 441/106; 182/3; 2/92

[56] References Cited

U.S. PATENT DOCUMENTS

| | | | |
|---|---|---|---|
| 4,047,255 | 9/1977 | Kiefer | 441/106 X |
| 5,140,995 | 8/1992 | Uhl | 2/92 X |

FOREIGN PATENT DOCUMENTS

| | | | |
|---|---|---|---|
| 0175955 | 4/1986 | European Pat. Off. . | |
| 2324506 | 4/1977 | France | 114/35.2 |
| 81126255 | 12/1981 | Germany . | |
| 3244106 | 6/1984 | Germany . | |
| 4228423 | 9/1993 | Germany . | |

OTHER PUBLICATIONS

"Dainese Back Protectors", Lockhart Racing Phillips 1992 Catalog, p. 79.

*Primary Examiner*—Sherman Basinger
*Attorney, Agent, or Firm*—Young & Thompson

[57] ABSTRACT

A chest trapeze (1) is cut to size from a flexible plate (2) made of plastic, which is sewn in a tear-resistant covering (3) made of a synthetic fiber fabric. The chest trapeze (1) has a back part (4), two hip and abdominal parts (5, 6) extending crosswise to the latter and two shoulder parts (7, 8) adjoining the back part (4). A support for the lumbar area of the spinal column (9) of a surfer or sailor, made of support elements (11) with limited flexibility interlocking with one another, is integrated in the back part (4). The mode of action of support elements (11) is such that when the surfer leans back, the support elements are pushed together into a stiff brace matched to the curvature of the spinal column (9) in the lumbar area, and when the surfer bends forward, the support elements spread out from one another into a flexible link belt. Trapeze (1) thus assures that with the various maneuvers, the surfer enjoys full freedom of movement.

14 Claims, 4 Drawing Sheets

Fig. 3
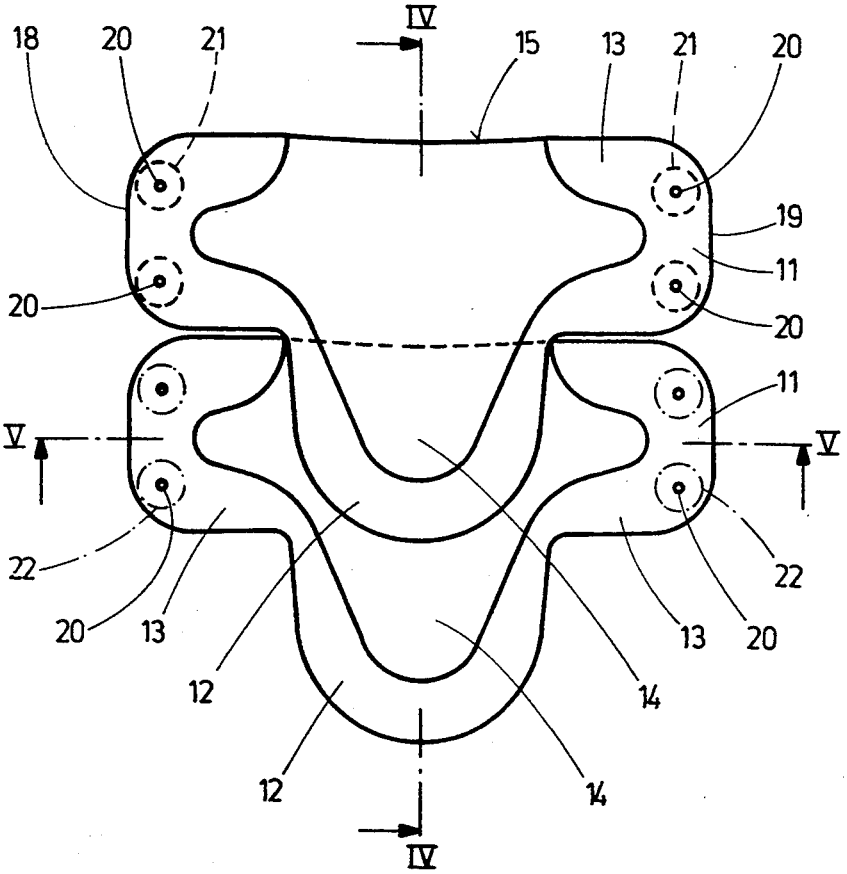
Fig. 4
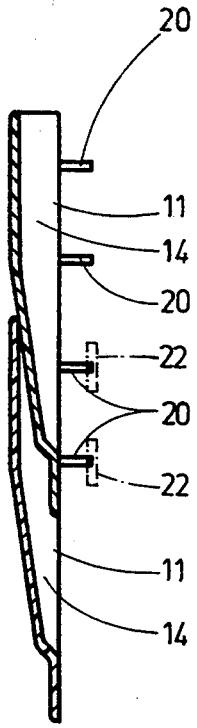
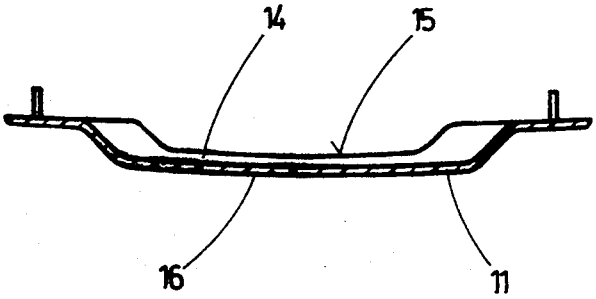
Fig. 5

TRAPEZE FOR SURFERS AND SAILORS

FIELD OF THE INVENTION

The invention relates to a trapeze for surfers and sailors, with a back part, two hip and abdominal parts extending crosswise to the latter, and two shoulder parts adjoining the back part, which consist of one or more flexible plate or plates made of a plastic, a lumbar-support part, a tear-resistant covering of the plate or plates made of synthetic fiber fabric as well as with back and shoulder straps to fasten the trapeze to a hooked plate or a straddling rail with a trapeze hook.

BACKGROUND OF THE INVENTION

Such trapezes according to EP 175 955 A1 make it possible for the surfer or the sailor, if he sails with the surfboard or the sailboat hard to the wind, to ride out far over the surfboard or the side of the sailboat, to achieve in this way a favorable center of gravity position. In addition, the generic trapeze allows the surfer and sailor great relief of the strain on the arms for rest phases. The trapeze known by EP 175 955 A1 is equipped with a support part arched inward, matched to the lumbar area of the spinal column, which brings about optimal support of the spinal column and is to counteract a slipping of the trapeze on the body.

But the mode of action aimed at with this lumbar-support part of the known trapeze is inadequate. As a further drawback, the freedom of movement of the surfer and the sailor in the various maneuvers is hindered by the support part integrated in the trapeze.

SUMMARY OF THE INVENTION

The object of the invention is to develop a trapeze for surfers and sailors with a support for the lumbar area, which makes possible an effective remedy in the case of an onset and for prevention of backaches occurring while windsurfing and sailing, without the freedom of movement of the surfer and the sailor being restricted.

The trapeze according to the invention is distinguished by the following advantages:

The support integrated in the trapeze for the lumbar area of a surfer or sailor made of support elements interlocked with one another, which, when the surfer or sailor leans back, are pushed together into a stiff brace matched to the curvature of the spinal column in the lumbar area, and which, when the surfer or sailor bends forward, spread out from one another into a flexible link belt, assures an effective remedy for and prevention of backaches occurring while windsurfing and sailing by an optimal orthopedic fit. The support elements provide for an optimal freedom of movement when bending forward and a comfortable support of the spinal column when leaning back. By fastening one or two foam cushions to the inside of the back part of the trapeze in the lumbar area by a Velcro belt closure, the trapeze can be matched individually to the spinal column of the surfer and the sailor. The support of the lumbar area by the support elements interlocked with one another in connection with the elastically formed, lengthwise-adjustable shoulder straps, as well as the also lengthwise-adjustable back and posterior straps, makes possible an optimal transmission of force by the trapeze and as a result, controlled fatigue-free wind-surfing. Further, the desired height of the trapeze hook can be adjusted infinitely variably by lengthwise-adjustable shoulder, back, posterior and leg straps. Finally, the support elements having limited flexibility, integrated in the trapeze, protect the spinal column, kidneys and muscles from injuries, e.g., in the case of collisions and falls with landings on one's back, and the trapeze provides for an effective protection from cold.

BRIEF DESCRIPTION OF THE DRAWINGS

The invention is explained in more detail below based on two embodiments represented in the drawing. There is shown in:

FIG. 3 an inside view of two support elements of the trapeze engaging in one another in enlarged representation, FIG. 4 a lengthwise section through two support elements along line IV—IV of FIG. 3, FIG. 5 a crosswise section through a support element along line V—V of FIG. 3, FIG. 6*a* and 6*b* the mode of action of the support elements of the trapeze when a surfer leans back and bends forward, FIG. 7 an outside view of a seat-hip trapeze and FIG. 8 an inside view of the trapeze according to FIG. 7.

DETAILED DESCRIPTION OF THE INVENTION

In the two trapeze designs described below, same or similar parts are identified by the same reference symbols.

Figure 2:
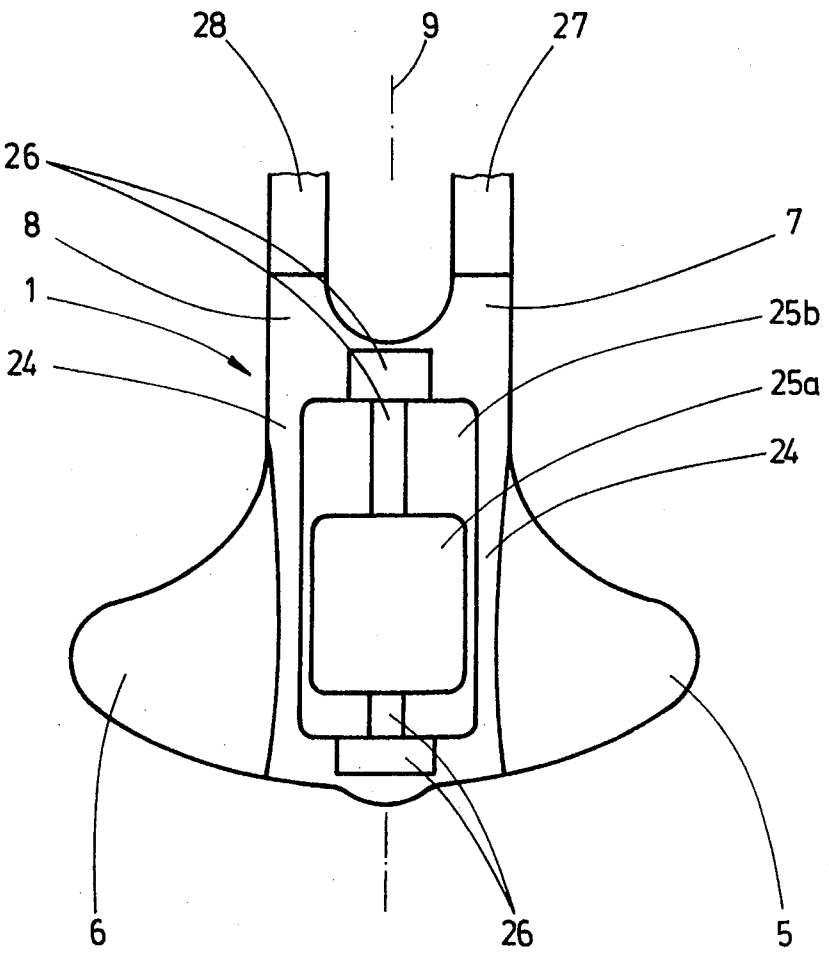
FIG. 2 an inside view of the chest trapeze according to FIG. 1.
Figure 1:
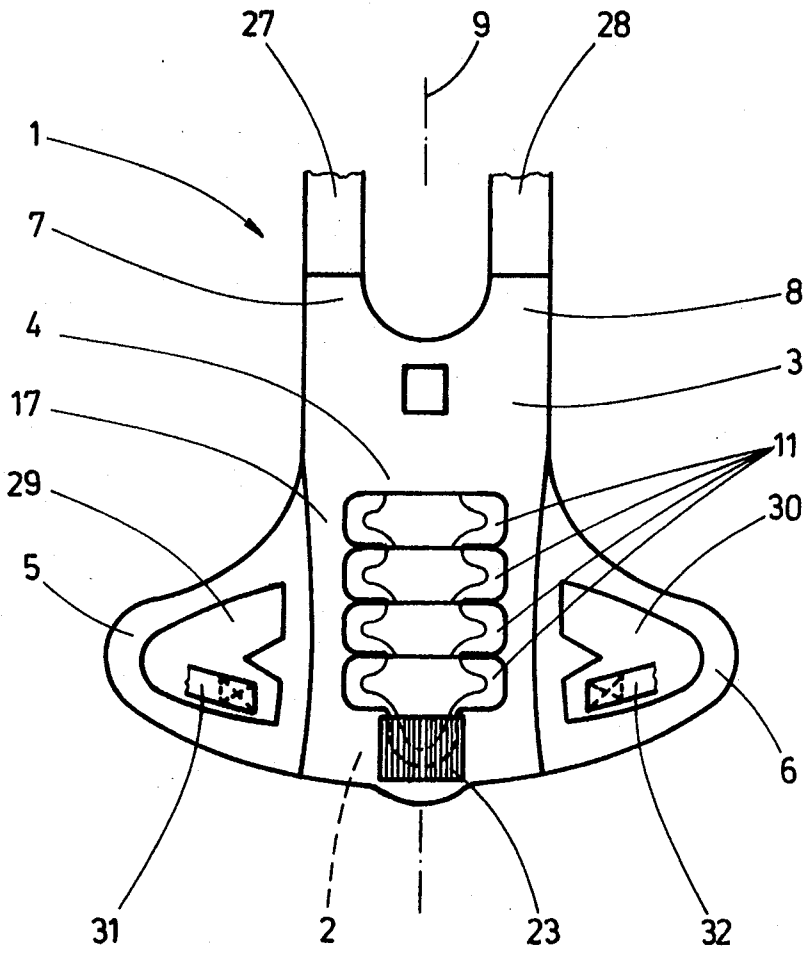
FIG. 1 An outside view of a chest trapeze.

Chest trapeze 1 according to FIG. 1 and 2 is cut to size from a flexible plate 2 made of plastic, preferably a closed-cell foam, which is sewn in a tear-resistant covering 3 made of a synthetic fiber fabric, e.g., a nylon fabric.

Chest trapeze 1 exhibits a back part 4, two hip and abdominal parts 5, 6 extending crosswise to the back part and two shoulder parts 7, 8 adjoining back part 4.

A support for lumbar area 10 of spinal column 9 of a surfer or sailor made of limited flexible support elements 11 interlocking with one another is integrated in back part 4.

Support elements 11 produced as injection molding parts made of plastic exhibit a T-shape with a lengthwise web 12 and a crosswise web 13, which are indented like a flat dish, and dish-shaped indentation 14 is open toward upper edge 15 of crosswise web 13. Support elements 11 have a slight curvature 16 corresponding to the shape of the back of a surfer or sailor.

Support elements 11 are fastened to outside 17 of back part 4 so that their dish-shaped indentations 14 point outward and lengthwise web 12 of the upper support element of two adjacent support elements 11 placed in the direction of spinal column 9 lies in indentation 14 of the lower support element.

To fasten support elements 11 on trapeze 1, metal rivets 20 with their head rivets 21 are molded-in on both narrow sides 18, 19 of crosswise web 13, rivets 20 are inserted through corresponding holes from outside through back part 4 and pressed on riveting disks 22 made of plastic from inside.

Lengthwise web 12 of bottommost support element 11 is held by a strap section 23 sewn on back part 4 from outside.

Two cushions 25*a*, 25*b* made of foam are fastened removably by Velcro belt closure 26 on inside 24 of back part 4 for additional support of lumbar area 10 of spinal column 9 and adjustment of the bending resistance of back part 4 when bending forward and leaning back.

Two elastically designed shoulder straps 27, 28 are sewn on shoulder parts 7, 8.

Two flexible stiffening plates 29, 30 made of plastic or leather are sewn on back part 4 from outside, plates on which two back straps 31, 32 are tightly sewn.

Figure 8:
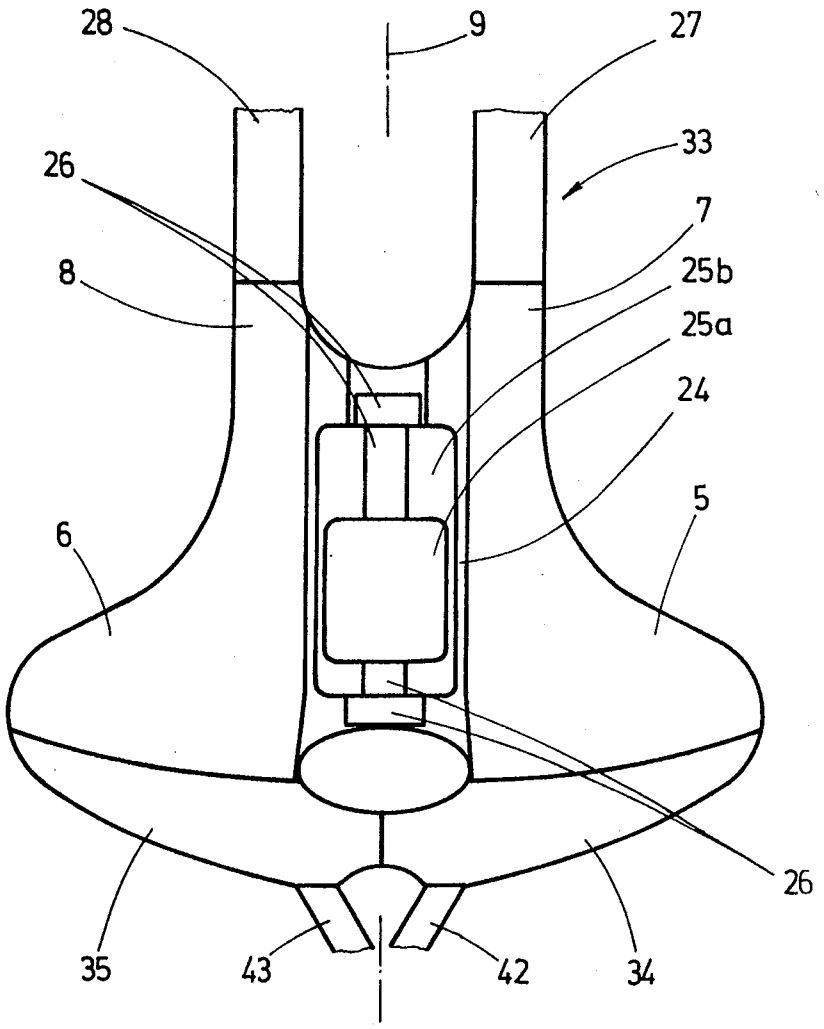
Figure 7:
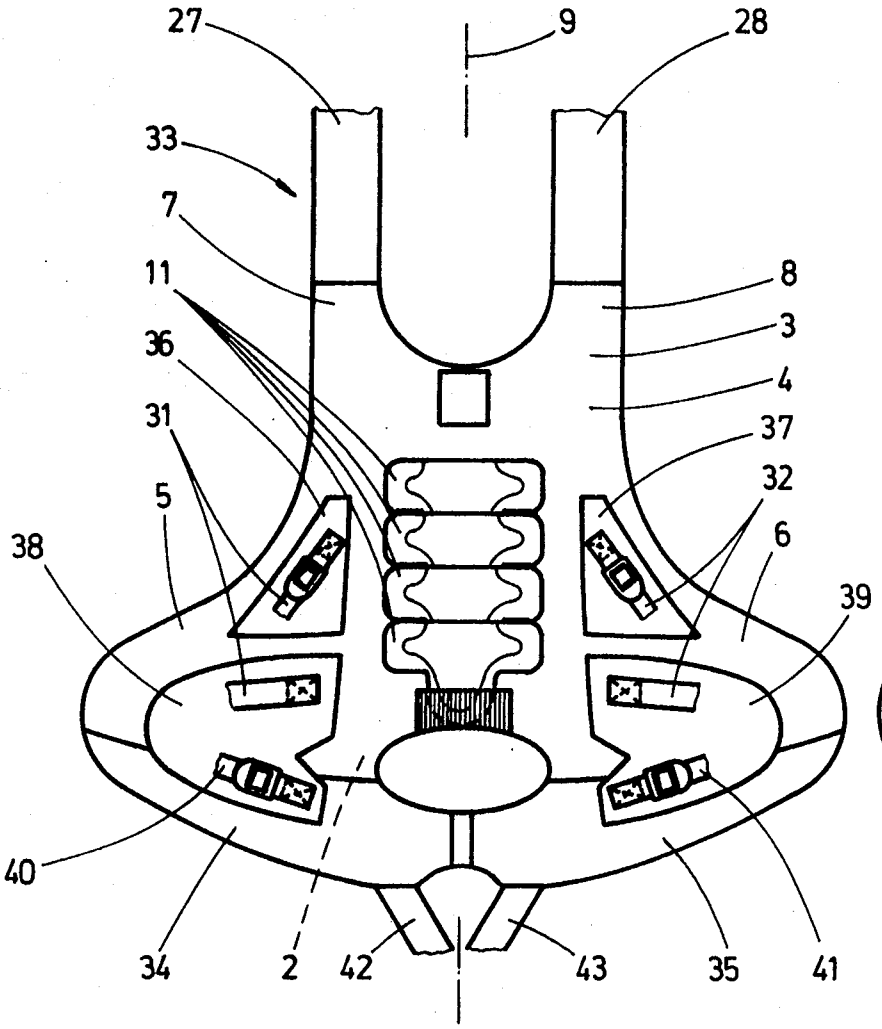

Trapeze 33 designed as a seat-hip trapeze according to FIG. 7 and 8 exhibits, relative to chest trapeze 1 according to FIG. 1 and 2, in addition two seat parts 34, 35 adjoining two hip-abdominal parts 5, 6.

In the case of seat-hip trapeze 33, two back straps 31, 32, are each tightly sewn on two flexible stiffening plates 36, 37 and 38, 39 sewn on back part 4, hip and abdominal parts 5, 6 and seat parts 34, 35. Seat-hip trapeze 33 further exhibits two posterior straps 40, 41 tightly sewn to stiffening plates 38, 39 as well as two leg straps 42, 43 sewn on two seat parts 34, 35.

In the case of chest trapeze 1, shoulder straps 27, 28 and back straps 31, 32, and in the case of seat-hip trapeze 33, in addition posterior straps 40, 41 and leg straps 42, 43 are adjustable in length to adjust the desired tension and the height of trapeze hook 45 placed on a straddling rail 44 or a hooked plate.

Figure 6B:
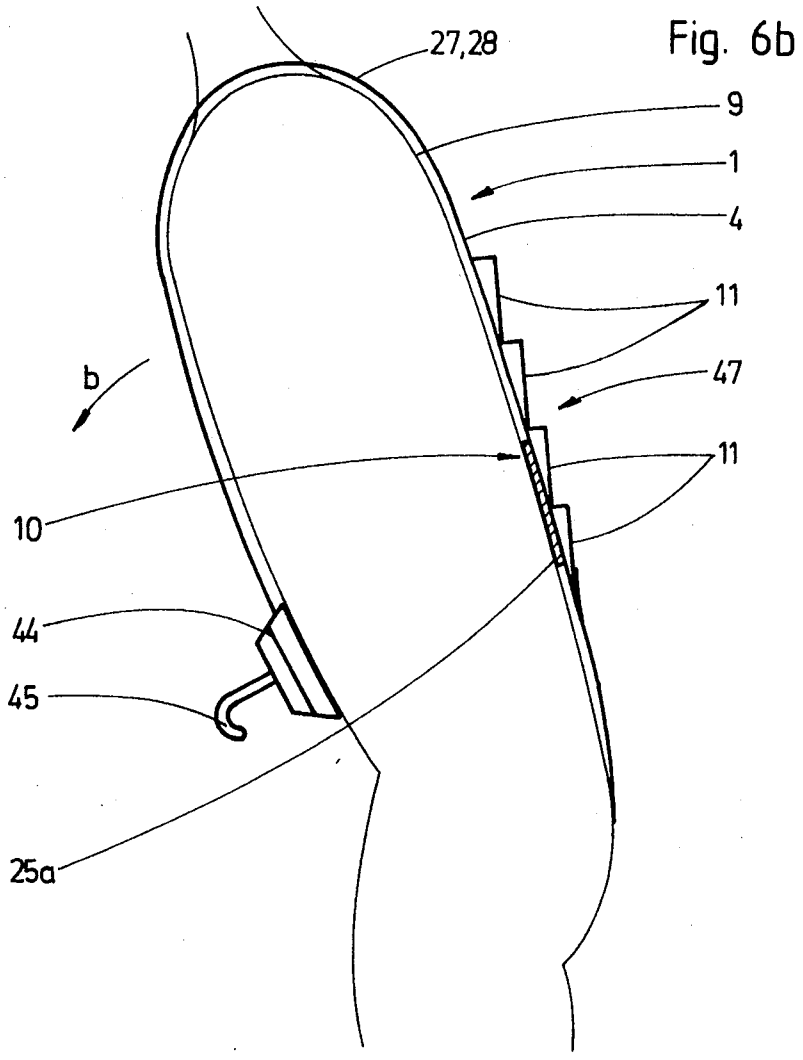
Figure 6A:
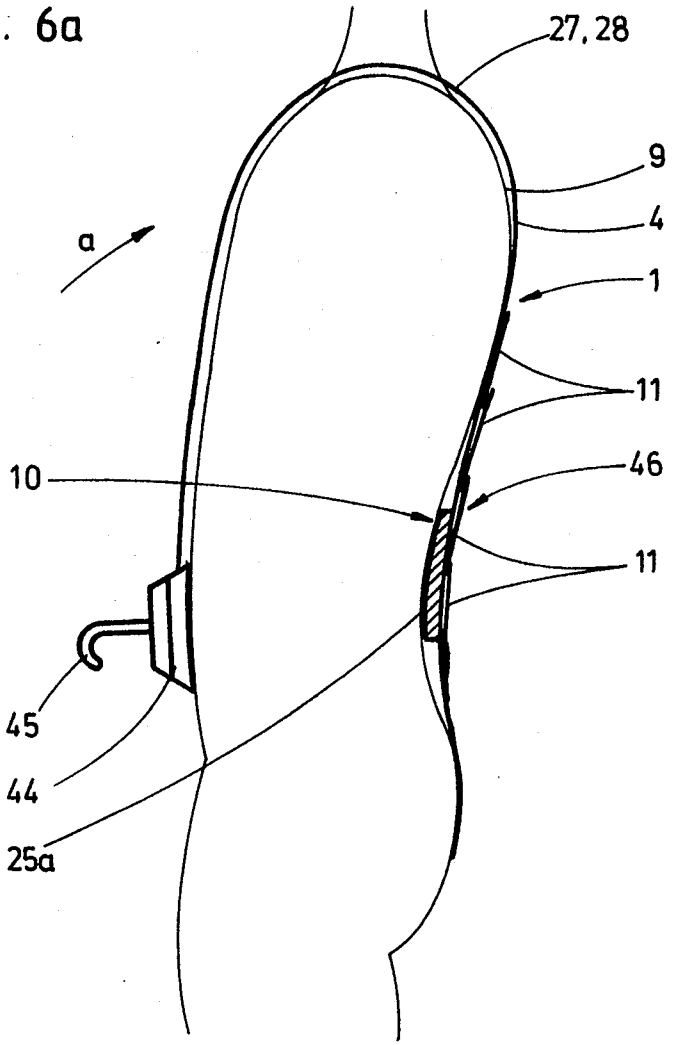

The mode of action of support elements 11 integrated in back part 4 of trapezes 1, 33 is such that when the surfer leans back in the direction of arrow a according to FIG. 6*a*, the support elements are pushed together into a stiff brace 46 matched to the curvature of spinal column 9 in lumbar area 10, and when the surfer bends forward in the direction of arrow b represented in FIG. 6*b*, spread apart from one another into a flexible link belt 47.

What is claimed is:

1. Trapeze for surfers comprising:

a back part (4), two hip and abdominal parts (5, 6) extending crosswise to the back part (4), and two shoulder parts (7, 8) adjoining the back part (4), said shoulder parts (7, 8) comprising at least one flexible plate (2) made of plastic, a tear-resistant covering (3) of said at least one plate (2) made of synthetic fiber fabric and having back straps (31, 32) and shoulder straps (27, 28) for fastening said trapeze (1, 33) to a support (44) with a trapeze hook (45), and lumbar support integrated in said back part (4) for a lumbar area (10) of a surfer, said lumbar support comprising elements (11) with limited flexibility interlocked with one another, which, when the surfer leans back, are pushed together into a stiff brace (46) matched to the curvature of the surfer's spinal column (9) in said lumbar area (10), and which, when the surfer bends forward, spread apart from one another into a flexible link belt (47).

2. Trapeze according to claim 1, wherein said support elements (11) exhibit a T-shape with a lengthwise web (12) and a crosswise web (13), which comprise an indentation (14) which is generally concave relative to said back part, which indentation is open toward an upper edge (15) of said crosswise web (13).

3. Trapeze according to claim 2, wherein said support elements (11) are fastened to the outside (17) of said back part (4), so that their indentations (14) point outward, and said lengthwise web (12) of an upper support element of two adjacent support elements (11) placed in the direction of the surfer's spinal column (9) lies in said indentation (14) of the lower support element.

4. Trapeze according to claim 1, wherein said support elements have a slight curvature (16) corresponding to the shape of the back of a surfer.

5. Trapeze according to claim 1, wherein said support elements (11) are produced as injection molded parts made of plastic.

6. Trapeze according to claim 2, wherein said crosswise web comprises narrow sides, and to fasten said support elements (11) on said trapeze (1, 33), rivets (20) with rivet heads (21) are molded-in on both narrow sides (18, 19), said rivets (20) being inserted through holes from the outside through said back part (4) and onto which riveting disks (22) are pressed from inside.

7. Trapeze according to claim 6, wherein said rivets (20) are of metal and said riveting disks (22) are of plastic.

8. Trapeze according to claim 2, wherein said lengthwise web (12) of the support element (11) located at the bottom of the lumbar area is held by a strap section (23) sewn on said back part (4) from the outside.

9. Trapeze according to claim 1, further comprising at least one cushion (25*a*, 25*b*) of plastic fastened removably by hook-and-eye fabric closure (26) on the inside (24) of said back part (4) for additional support of the lumbar area (10) of the surfer's spinal column (9) and for adjustment of the bending resistance of said back part (4) when bending forward and leaning back.

10. Trapeze according to claim 1, further comprising elastic shoulder straps (27, 28).

11. Trapeze according to claim 1, comprised by a seat-hip trapeze (33) with two seat parts (34, 35) adjoining said hip-abdominal parts (5, 6).

12. Trapeze according to claim 11, further comprising leg straps (42, 43) sewn on said seat parts (34, 35).

13. Trapeze according to claim 1, comprising back straps (31, 32), posterior straps (40, 41) and leg straps (42, 43), fastened to the outside (17) of said back part, which are adjustable in length to adjust the desired tension and the height of said trapeze hook (45).

14. Trapeze according to claim 13, wherein said back straps (31, 32) and posterior straps (40, 41) are tightly sewn to flexible stiffening plates (29, 30; 36–39) sewn on the outside of said back part (4) and said hip and abdominal parts (5, 6) and seat parts (34, 35) adjoining said hip and abdominal parts.

* * * * *